United States Patent [19]

Galbani

[11] Patent Number: 4,883,177

[45] Date of Patent: Nov. 28, 1989

[54] PLATE MOUNTABLE ON THE BASE OF A BIN-TYPE CONTAINER FOR THE ORDERED STORAGE OF BOBBINS

[75] Inventor: Benito Galbani, Pordenone, Italy

[73] Assignee: Savio S.p.A., Pordenone, Italy

[21] Appl. No.: 244,709

[22] Filed: Sep. 15, 1988

[30] Foreign Application Priority Data

Sep. 25, 1987 [IT] Italy ..... 22422/87[U]

[51] Int. Cl.[4] ..... B65D 85/66

[52] U.S. Cl. ..... 206/391; 220/1.5

[58] Field of Search ..... 206/391, 392, 393, 394; 220/1.5

[56] References Cited

U.S. PATENT DOCUMENTS 3,460,684 8/1969 Almasy .
3,765,539 10/1973 Boyce .

FOREIGN PATENT DOCUMENTS 2346145 3/1975 Fed. Rep. of Germany .
1580023 11/1980 United Kingdom .

*Primary Examiner*—Joseph Man-Fu Moy
*Attorney, Agent, or Firm*—Hedman, Gibson, Costigan & Hoare

[57] ABSTRACT

A plate mountable on the base of a bin-type container and advantageously profiled with transverse projections to provide the first layer of bobbins with stability against rolling, and also ensure that the subsequent filling takes place in accordance with precise storage configurations in order to obtain a considerable storage density.

The profiling of the removable plate is universal, i.e. is suitable for any diameter of cylindrical or conical bobbin.

4 Claims, 2 Drawing Sheets

PLATE MOUNTABLE ON THE BASE OF A BIN-TYPE CONTAINER FOR THE ORDERED STORAGE OF BOBBINS

This invention relates to a bobbin storage container carrying a base plate provided with two semitrapezoidal end projections and a plurality of intermediate projections, of which at least two are of triangular or substantially cuspidal cross-section, and at least a further two are of substantially trapezoidal cross-section.

Said transversely extending projections provide the first layer of deposited bobbins with stability against rolling, and also ensure that the subsequent filling takes place in accordance with precise storage configurations in order to enable the maximum number of bobbins to be contained.

At the end of the spinning process, the yarn produced is normally made up into cross-wound bobbins. These bobbins can be of any shape and size, and must be collected in ordered arrangement in bin-type containers for transfer to the next production departments or to storage.

In the description and claims given hereinafter, the textile packages leaving the winding units are known simply as bobbins or cross-wound bobbins, these terms being used interchangeably. In textile mills, the removal of bobbins from winding machines or from rotor spinning machines is an operation which within the rationalisation context still requires improvement.

It is well known that wheel-mounted bins, often with a removable base, are among the most used transportation means in the textile industry, they being used for conveying the cross-wound bobbins along sometimes lengthy paths.

When a yarn bobbin removal system is devised, account must be taken of the fact that the transportation means used become an integral part of the new system, in which any possible improvements can be of considerable importance.

An object of the present invention is to attain automatic ordered deposition in a simple and rational manner by means of simple cartesian manipulators which release the bobbins in accordance with preset coordinates so that the location of the bobbins on the container base is stabilised.

A further object is to use a universal base surface, ie one which is suitable for obtaining maximum filling density for any bobbin diameter normally produced in spinning or yarn winding departments.

In the known art, the base surface of a bin-type container is either flat or, in some applications, comprises projections which are sized and distributed so as to house bobbins of predetermined diameter and shape. When the set diameter and shape change, the operators have to replace the base with another base of the correct profile for the new type of bobbin. The present invention therefore provides a series of advantages which on the one hand rationalise the accumulation and storage of yarn bobbins and on the other hand result in an easing of the manual operations which the operators are required to perform.

These and further advantages are attained by the present invention, which is characterised by consisting of a plate either fixed or mountable on the base of a bin-type container for storing textile bobbins, said plate being provided with two end projections and a plurality of intermediate projections, of which at least two are of triangular or substantially cuspidal cross-section, and at least a further two are of substantially trapezoidal cross-section; the distance between two adjacent projections being such as to prevent or at most allow only limited rolling movement of the bobbin positioned between the two said projections.

According to one embodiment, the projections on the base plate extend transversely to the base and lie parallel to each other.

According to a further embodiment, said projections on the base plate are disposed symmetrically about the central vertical plane through the bin-type container.

With reference to the aforesaid, the two accompanying drawings illustrate one embodiment of the invention, said embodiment being described hereinafter with reference to the contained figures, of which:

In the figures, identical elements or those with identical or equivalent functions are indicated by the same reference numerals. Although cylindrical bobbins are shown diagrammatically, the removable or fixed base plate is also suitable for the collection of frusto-conical bobbins.

Figure 1:
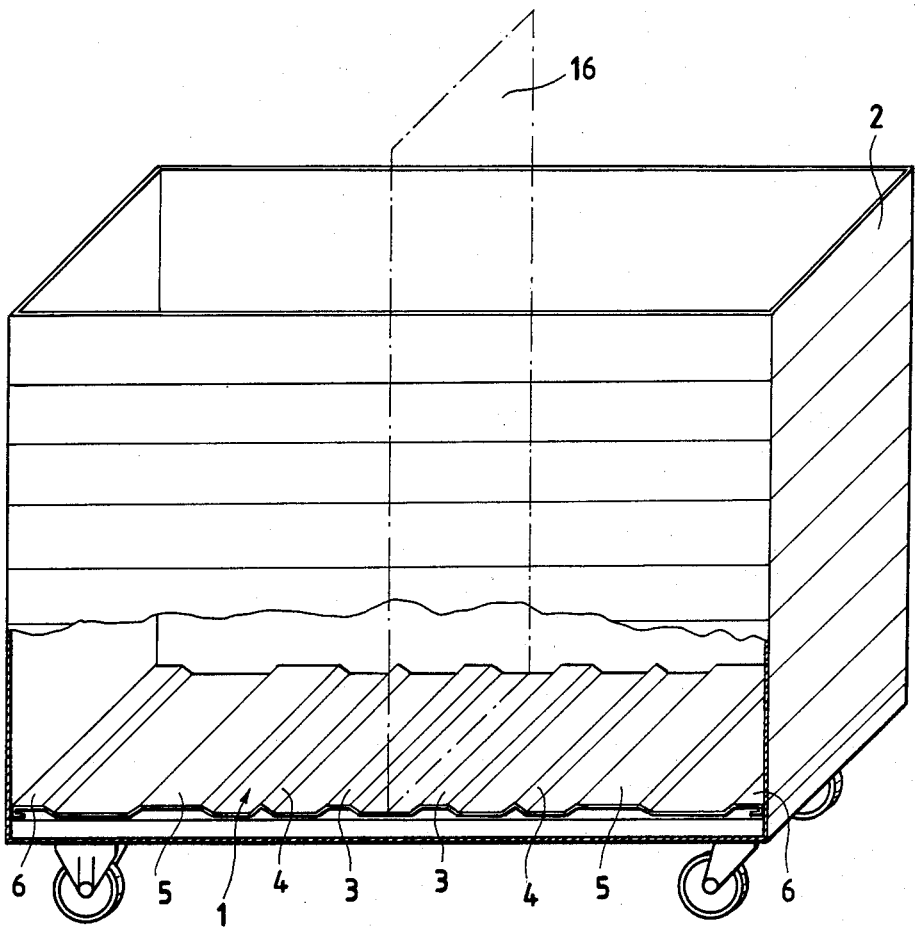
FIG. 1 is an isometric view of the wheel-mounted bin-type container with which the base plate shaped with a plurality of projections having a shape and distribution according to the present invention is associated.
Figure 2:
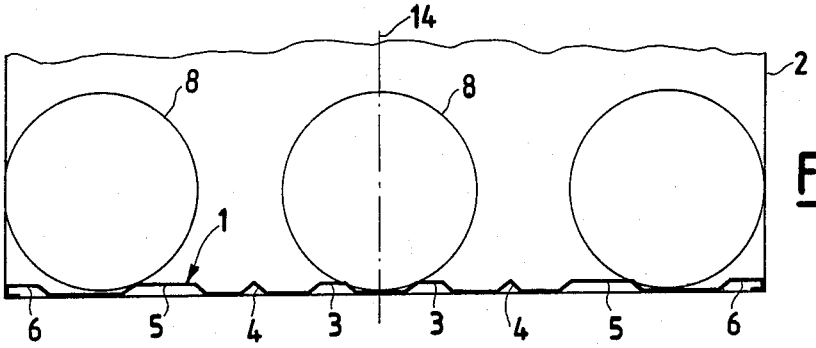
FIG. 2 is a frontal diagrammatic section showing the association of the base plate profile with large-diameter bobbins.
Figure 3:
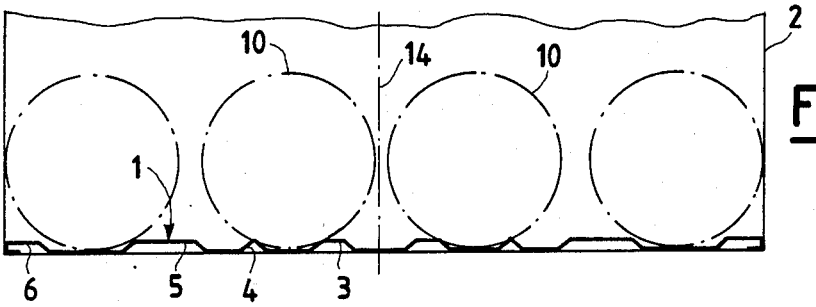
FIG. 3 is a frontal diagrammatic section showing the association of the base plate profile with medium-diameter bobbins.
Figure 4:
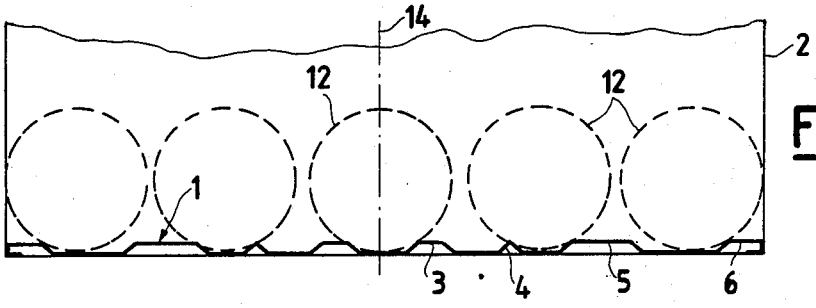
FIG. 4 is a frontal diagrammatic section showing the association of the base plate profile with small-diameter bobbins.
Figure 5:
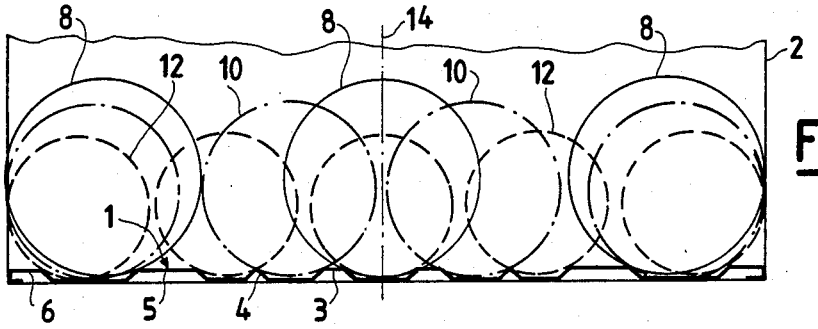
FIG. 5 is a frontal diagrammatic section showing the association of the base plate profile with bobbins of different diameters.

In the accompanying drawings: 1 is the removable or fixed base of the bin-type container 2, said plate being profiled with transverse projection; 2 is the wheel-mounted bin-type storage and conveying container for use within the mill; 3 is that transverse projection of trapezoidal cross-section close to the central plane of symmetry 16; 4 is a transverse projection of triangular cross-section; 5 is a transverse projection of trapezoidal cross-section; 6 is a transverse end projection on the base plate 1; 8 is the diagrammatic front profile of the large-diameter bobbin; 10 is the diagrammatic front profile of the medium-diameter bobbin; 12 is the diagrammatic front profile of the small-diameter bobbin; 14 is a line indicating the central vertical plane through the base plate 1 and bin-type container; 16 is an isometric representation of the plane indicated by the line 14.

What is claimed is:

1. A bin-type container for storing different bobbins therein, comprising a base plate including two end projections and a plurality of intermediate projections therebetween wherein at least two of said intermediate projections have a substantially cuspidal cross section and at least a further two intermediate projections have a substantially trapezoidal cross section, and wherein two adjacent intermediate projections are spaced a distance apart, all for limiting movement of the bobbins stored in the bin.

2. A base plate for a bin-type container for storing different bobbins, wherein said base plate comprises two end projections and a plurality of intermediate projections therebetween wherein at least two of said intermediate projections have a substantially cuspidal cross section and at least a further two intermediate projections have a substantially trapezoidal cross section, and wherein two adjacent intermediate projections are spaced a distance apart, all for limiting movement of the bobbins stored in the bin.

3. The base of plate of claim 1 or 2, wherein said projections on said base plate extend transversely thereto and parallel with each other.

4. The base plate of claim 3 wherein said base plate projections are disposed symmetrically about the central vertical plane of said base plate, said plane being parallel to said projections.

* * * * *